US009227702B2

(12) United States Patent
Rijken et al.

(10) Patent No.: US 9,227,702 B2
(45) Date of Patent: Jan. 5, 2016

(54) BALLAST SYSTEM FOR FLOATING OFFSHORE PLATFORMS

(71) Applicant: Seahorse Equipment Corp, Houston, TX (US)

(72) Inventors: Oriol R. Rijken, Houston, TX (US); Edward Sean Large, Houston, TX (US); Sjoerd Hoekstra, Houston, TX (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

(21) Appl. No.: 13/874,108

(22) Filed: Apr. 30, 2013

(65) Prior Publication Data

US 2013/0287502 A1 Oct. 31, 2013

Related U.S. Application Data

(60) Provisional application No. 61/640,314, filed on Apr. 30, 2012, provisional application No. 61/644,812, filed on May 9, 2012.

(51) Int. Cl.

| | |
|---|---|
| ***B63B 43/06*** | (2006.01) |
| ***B63B 21/50*** | (2006.01) |
| ***B63G 8/22*** | (2006.01) |
| ***B63B 11/00*** | (2006.01) |
| *B63B 1/10* | (2006.01) |
| *B63B 35/44* | (2006.01) |

(52) U.S. Cl.

CPC ..... *B63B 21/502* (2013.01); *B63B 11/00* (2013.01); *B63B 43/06* (2013.01); *B63G 8/22* (2013.01); *B63B 1/107* (2013.01); *B63B 35/4413* (2013.01); *B63B 2035/442* (2013.01); *B63B 2035/448* (2013.01)

(58) Field of Classification Search

USPC ..... 405/200, 205–28, 223.1, 224; 114/264–266, 125, 74 A, 74 R, 333

See application file for complete search history.

(56) References Cited

U.S. PATENT DOCUMENTS

| | | | | |
|---|---|---|---|---|
| 3,145,539 | A * | 8/1964 | Estes et al. | 405/210 |
| RE29,478 | E * | 11/1977 | Goren et al. | 114/265 |
| 6,044,788 | A * | 4/2000 | Larson et al. | 114/253 |
| 6,935,810 | B2 * | 8/2005 | Horton, III | 405/200 |
| 2013/0180445 | A1 | 7/2013 | Large et al. | |

* cited by examiner

*Primary Examiner* — Sunil Singh
(74) *Attorney, Agent, or Firm* — Blank Rome LLP

(57) ABSTRACT

A floating, offshore drilling and/or production platform such as a tension leg platform, semi-submersible, spar or the like is equipped with a ballast tank system that comprises the traditional tank and a shaft that runs typically vertically from top-of-hull level to the top of the tank. This shaft is large enough to allow the ballast pipe, sounding lines, instrumentation piping, etc. to be installed within it. In certain embodiments, the shaft itself functions as a vent line.

24 Claims, 6 Drawing Sheets

BALLAST SYSTEM FOR FLOATING OFFSHORE PLATFORMS

CROSS-REFERENCE TO RELATED APPLICATIONS

This application claims the benefit of U.S. Provisional Application No. 61/640,314 filed on Apr. 30, 2012, and U.S. Provisional Application No. 61/644,812 filed on May 9, 2012. The disclosures of both of these applications are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

This invention relates to floating offshore platforms. More particularly, it relates to the water ballast and bilge systems used in floating offshore platforms.

2. Description of the Related Art Including Information Disclosed Under 37 CFR 1.97 and 1.98

Various floating structures are used for offshore drilling and production operations. Examples include tension leg platforms (TLP's), semi-submersible floating vessels ("semis"), spars and floating production, storage and offloading vessels (FPSO's). Each of these vessel types may include a water ballast system.

A ship may have a single ballast tank near its center or multiple ballast tanks typically on either side. A large vessel typically will have several ballast tanks including double bottom tanks, wing tanks as well as forepeak and aftpeak tanks. Adding ballast to a vessel lowers its center of gravity, and increases the draft of the vessel. Increased draft may be required for proper propeller immersion.

A ballast tank can be filled or emptied in order to adjust the amount of ballast force. Ships designed for carrying large amounts of cargo must take on ballast water for proper stability when travelling with light loads and discharge water when heavily laden with cargo. Small sailboats designed to be lightweight for being pulled behind automobiles on trailers can be designed with ballast tanks that may be emptied when the boat is removed from the water.

In submarines, ballast tanks are used to allow the vessel to submerge, water being taken in to alter the vessel's buoyancy and allow the submarine to dive. In order for the submarine to surface, water is displaced from the tanks using compressed air, and the vessel becomes positively buoyant again, allowing it to rise to the surface. A submarine may have several types of ballast tank: the main ballast tanks, which are the main tanks used for diving and surfacing, and trimming tanks, which are used to adjust the submarine's attitude (its 'trim') both on the surface and when underwater.

Ballast tanks are also integral to the stability and operation of deepwater offshore oil platforms and similar structures such as floating wind turbines. The ballast facilitates hydrodynamic stability by moving the center-of-mass as low as possible, placing it beneath the air-filled buoyancy tank(s).

Vessels such as TLP's, semis, spars and FPSO's typically require ballast tanks for weight and trim control. These tanks are usually distributed throughout the vessel, and a piping system allows these tanks to be filled and drained (ballasted). The piping system is typically located near the lower parts of each tank.

BRIEF SUMMARY OF THE INVENTION

A ballast tank configuration according to the present invention comprises the traditional tank but with the addition of a shaft that runs generally vertically from top-of-hull level to the top of the tank. This shaft is large enough to allow the ballast pipe, sounding lines, instrumentation piping, etc. to be installed within it. The shaft and the tank to which it is attached may comprise a single volume. The shaft itself may act as a vent line.

BRIEF DESCRIPTION OF THE SEVERAL VIEWS OF THE DRAWING(S)

DETAILED DESCRIPTION OF THE INVENTION

Figure 1:
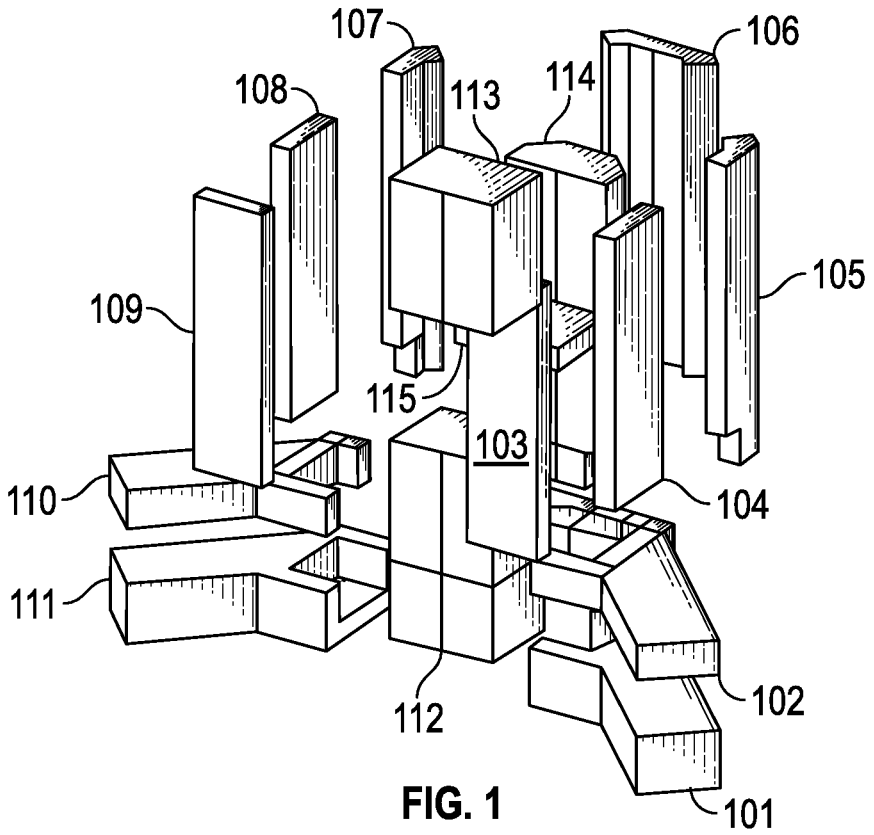
FIG. 1 is an exploded, isometric view from the inboard side of the compartments according to one embodiment of the invention comprising a column and adjoining pontoons of a TLP or semi-submersible.
Figure 2:
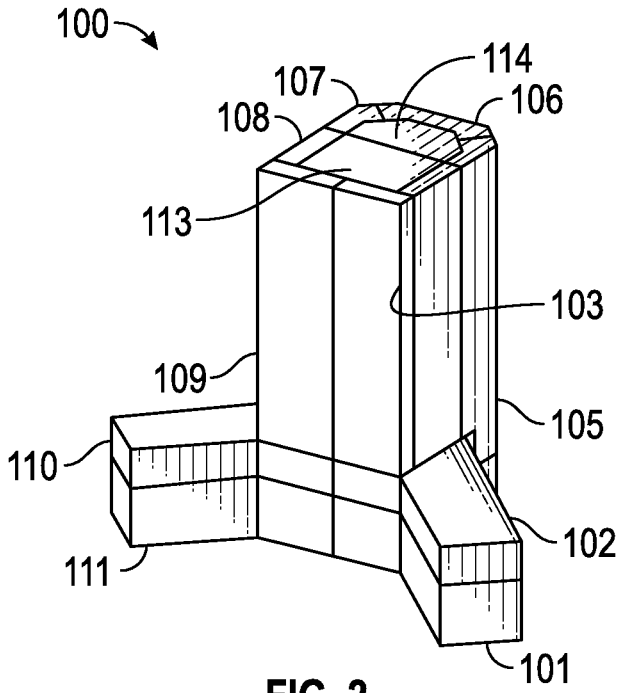
FIG. 2 is an isometric, assembled view of the compartments shown in FIG. 1.
Figure 3:
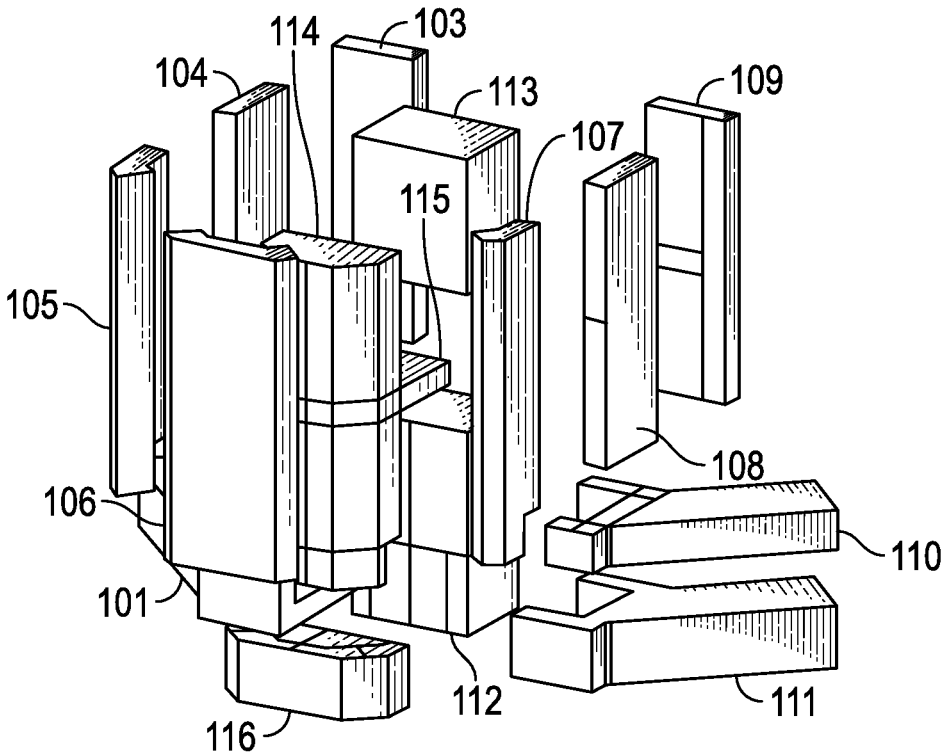
FIG. 3 is an exploded, isometric view from the outboard side of the compartments shown in FIGS. 1 and 2.
Figure 4:
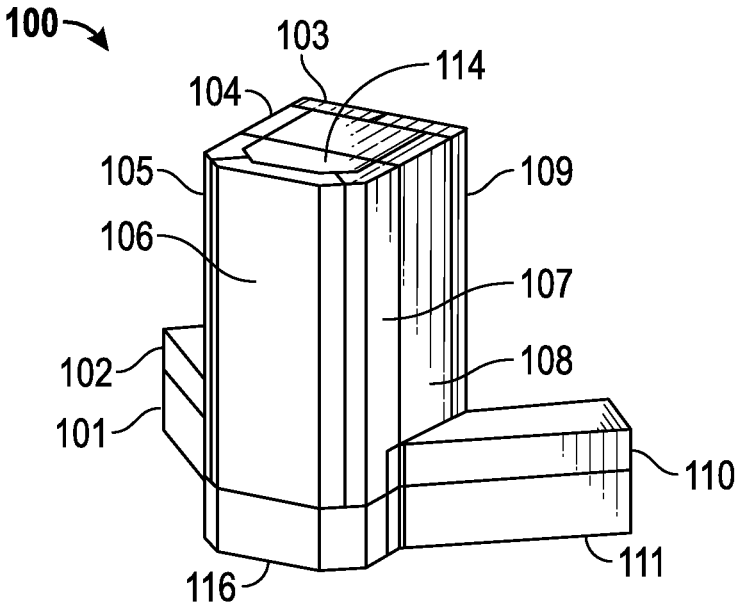
FIG. 4 is an isometric, assembled view of the compartments shown in FIG. 3.
Figure 5:
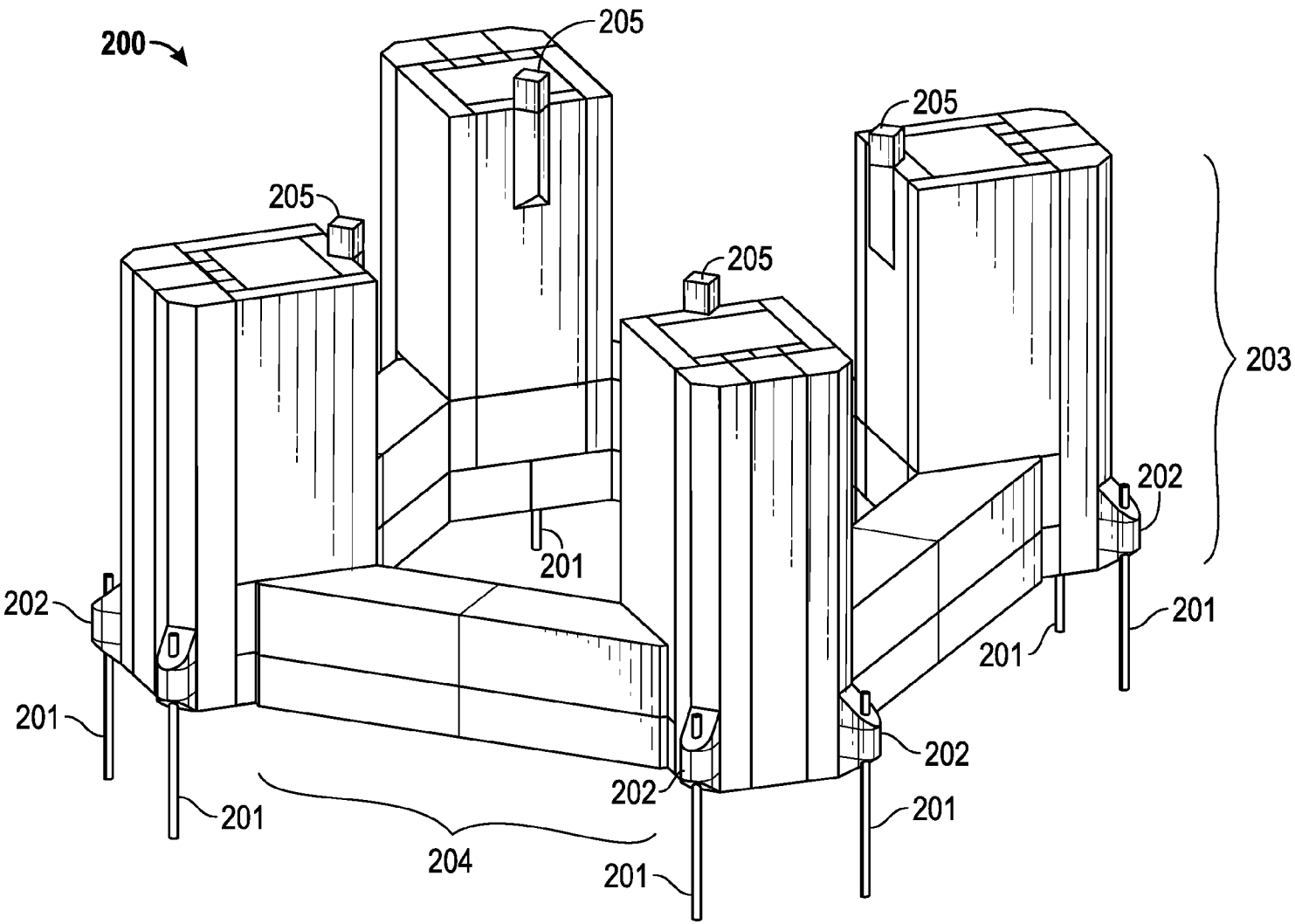
FIG. 5 is an isometric view of a TLP according to another embodiment of the invention.

Typical marine ballast systems consist of several ballast tanks, void spaces, piping, headers, ring mains, vent lines, valves, pumps, actuators, valve indicators and (hydraulic) control lines. Quite often there is a requirement for an additional bilge system. The pumps are typically located in the pump room, an area near the keel of the vessel. The pump room is often considered an occupied space and therefore requires HVAC and lighting systems. These systems themselves, and their layout can be quite complex. Moreover, all of these items need to be maintained throughout the platform's life, and the more complex the ballast and bilge system becomes, the more maintenance is required.

One embodiment of the invention is a design particularly applicable to Tension Leg Platforms and Semi-Submersibles. This aspect of the invention comprises a ballast/void tank layout for a column which comprises cofferdams.

The term "cofferdam" may be used to refer to an insulating space between two watertight bulkheads or decks within a ship or other vessel. A cofferdam may be a void (empty) space or a ballast space. In ships, cofferdams are usually employed to ensure that oil or other chemicals do not leak into machinery spaces. If two different cargoes that react dangerously with each other are carried on the same vessel, one or more cofferdams are usually required between the cargo spaces. The division between the tanks and the hull of a double-hulled vessel is not normally called a cofferdam, although it serves this function.

Each cofferdam according to the invention reaches from near a top-of-column elevation to a near top-of-pontoon elevation. A characteristic of these cofferdams is that their dimension in the vertical direction is much greater than their dimension in the horizontal direction. These cofferdams may be located around the column perimeter and enclose other tanks such as ballast tanks, void spaces and access shafts. The inboard/outboard dimension (width) of these cofferdams is greater than the collision zone, thereby limiting any expected collision damage to the cofferdams only.

The invention may best be understood by reference to the exemplary embodiment(s) illustrated in the drawing figures.

Referring now to FIGS. 1-4, one corner of a TLP or semi-submersible comprising a column (which extends from below the waterline to the deck support structure) and its adjacent pontoon tanks is shown in both exploded and assembled views.

Hull structure 100 comprises a column together with adjacent pontoon tanks. As used herein, the term "tank" refers to any enclosed compartment. Certain such compartments may be used as ballast tanks and/or buoyancy tanks.

Structure 100 comprises lower right side (as viewed in FIG. 1) pontoon tank 101, upper right side pontoon tank 102, perimeter cofferdams 103 through 109, inclusive, upper left side pontoon tank 110, lower left side pontoon tank 111, lower inboard column tank 112, upper inboard column tank 113, outboard column tank 114 (which includes lateral extension 115) and lower outboard column tank 116. In certain other embodiments, lower inboard column tank 112 and upper inboard column tank 113 may be combined into a single tank and lateral extension 115 may be omitted from outboard column tank 114.

Embodiments of hull structure 100 according to the invention may include the following elements:

- A column with compartments at the outer perimeter, with a substantially greater vertical dimension of the compartment compared to the horizontal compartment dimensions.
- A column with compartments on the outer perimeter wherein the floor of each compartment is located relatively close to the top-of-pontoon elevation.
- A column with compartments on the outer perimeter wherein the floor of the compartment is located relatively close to the lower collision zone elevation An advantageous feature that this design introduces relates to Damaged Compartment(s) requirements (per the vessel's classification society).

A classification society is a non-governmental organization that establishes and maintains technical standards for the construction and operation of ships and offshore structures. The society will also validate that construction is according to these standards and carry out regular surveys in service to ensure compliance with the standards.

Although classification societies generally explicitly take no responsibility for the safety, fitness for purpose, or seaworthiness of a vessel, they set technical rules, confirm that designs and calculations meet these rules, survey vessels and structures during the process of construction and commissioning, and periodically survey vessels to ensure that they continue to meet the rules. Classification societies are also responsible for classing oil platforms, other offshore structures, and submarines.

Cofferdams have been used in various designs to reduce the impact of Damaged Compartment(s) requirements. However, in the past, such cofferdams have typically been used only around the water line.

Damaged Compartment(s) requirements generally determine the size (volume) of compartments that are potentially subject to flooding. The challenge is to be able to accommodate those volumes, in particular when the volumes are small (compared to column displacement). Horizontally oriented (i.e., low height) compartments are much harder to implement from a structural (framing) perspective than vertically oriented (i.e., large height or cofferdam type compartments). The small volume requirement may arise for TLPs in benign environments where pretension is relatively low compared to the tension effect of Damaged Compartment(s), and or for TLPs or semis wherein the collision zone extends along a significant section of the column height. A design according to the invention permits the larger compartments to be excluded from the Damaged Compartment(s) requirement, enabling those compartments to have a significant volume.

Such a hull layout is very attractive when applying a corrosion allowance mitigation scheme—only one side of a stiffened wall is wet and the stiffeners may be located on the dry side. There is more exposed steel per unit area on the dry side than on the wet side. Inasmuch as the cofferdams and the ballast tank share a wall, the stiffeners may therefore be located in the cofferdams and not in the ballast tank.

In particular, this layout facilitates the implementation of the corrosion allowance mitigation scheme disclosed in commonly-owned U.S. patent application Ser. No. 13/741,043 filed on Jan. 14, 2013, and entitled "Method and Apparatus for Corrosion Allowance Mitigation," the disclosure of which is hereby incorporated by reference in its entirety.

A tall cofferdam system according to the invention also facilitates the marine system. Any ballast/bilge pump can be lowered directly into each cofferdam via an access (hatch) on its top-of-column upper surface.

A layout according to the invention provides particular benefits for a TLP, but such a layout may also be advantageously applied to a semi-submersible.

Another aspect of the present invention is illustrated in FIGS. 5 through 12, wherein a ballast system according to the invention comprises a shaft or caisson that connects an associated tank to an area on or near the top of the hull of the vessel:

a. The shaft may function as a vent line;
b. One or more lines may be run through this shaft or caisson. By way of example, these lines may service the following functions:
   i. Ballast
   ii. Sounding
   iii. Instrumentation
   iv. Temporary activities such as ventilation for inspection Referring now to FIG. 5, a four-column TLP 200 according to the invention is shown as an illustrative example. Surface-piercing columns 203 are interconnected by subsea pontoons 204. The TLP is anchored by means of tendons 201 attached to tendon porches located on certain outboard surfaces of columns 203. Deck posts 205 located on upper and inboard faces of columns 203 support a deck (not shown) having drilling and/or processing equipment thereon.

Figure 7:
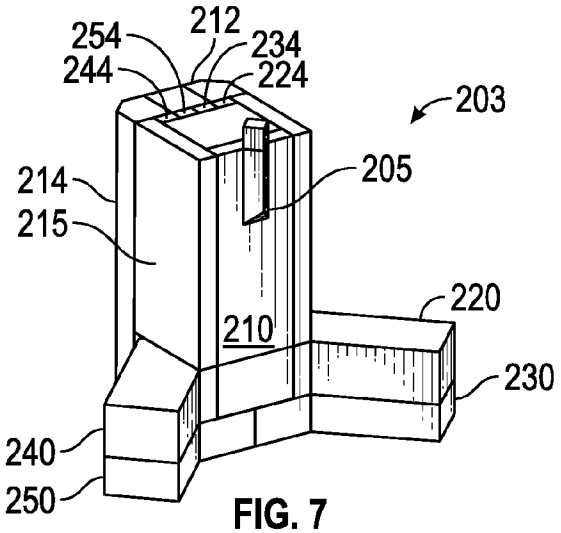
FIG. 7 is an isometric view from the inboard side of the compartments comprising a column and adjoining pontoons of a TLP or semi-submersible.
Figure 8:
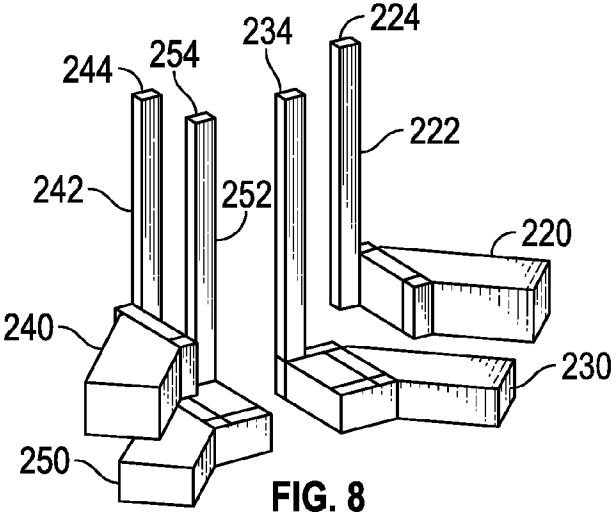
FIG. 8 is an isometric, exploded view of certain pontoon ballast tanks within the structure illustrated in FIG. 7.
Figure 6:
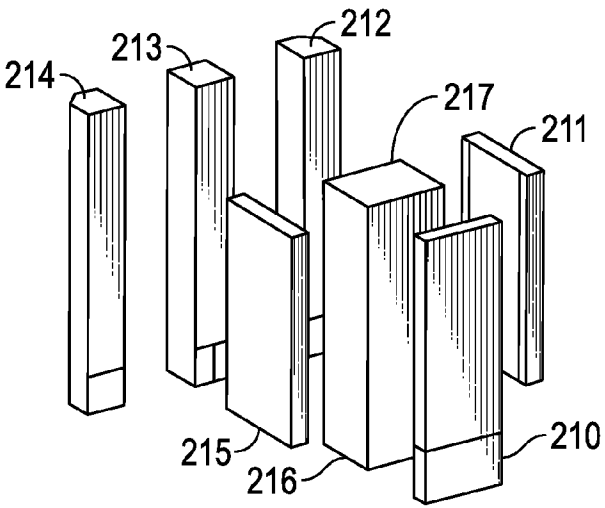
FIG. 6 is an exploded, isometric view from the inboard side of compartments comprising a column of a TLP or semi-submersible according to an embodiment of the invention.
Figure 10:
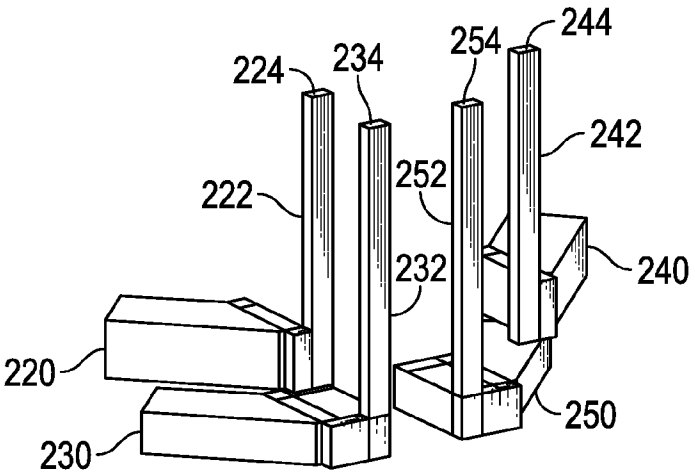
FIG. 10 is a exploded, isometric view from the outboard side of the ballast tanks shown in FIG. 8.
Figure 11:
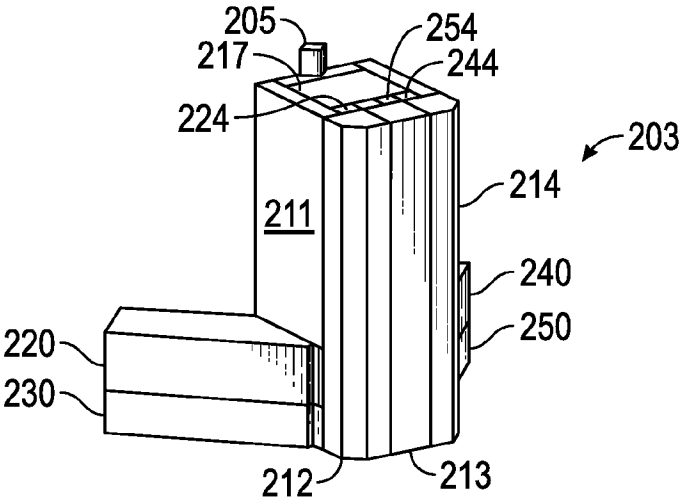
FIG. 11 is an isometric view from the outboard side of the structure shown in FIG. 7.
Figure 9:
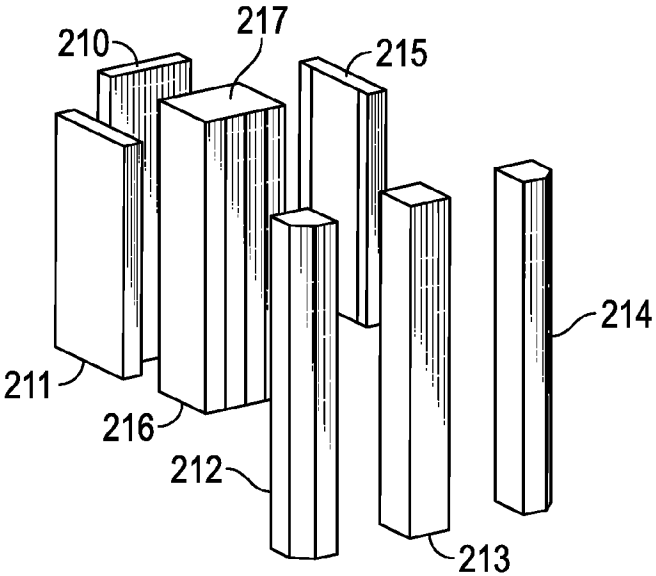
FIG. 9 is an exploded, isometric view from the outboard side of the compartments illustrated in FIG. 7.

A column structure 203 together with its adjacent pontoon tanks is shown in various exploded and assembled views in FIGS. 6-11, inclusive. Structure 203 comprises perimeter cofferdams 210-215, inclusive, central column tank 216 having upper surface 217, upper right (as shown in FIG. 7) pontoon tank 220 with associated vertical shaft 222 having upper surface 224 at the top of column 203, lower right pontoon tank 230 with associated vertical shaft 232 having upper surface 234 at the top of column 203, upper left pontoon tank 240 with associated vertical shaft 242 having upper surface 244 at the top of column 203, and lower left pontoon tank 250 with associated vertical shaft 252 having upper surface 254 at the top of column 203.

Figure 12:
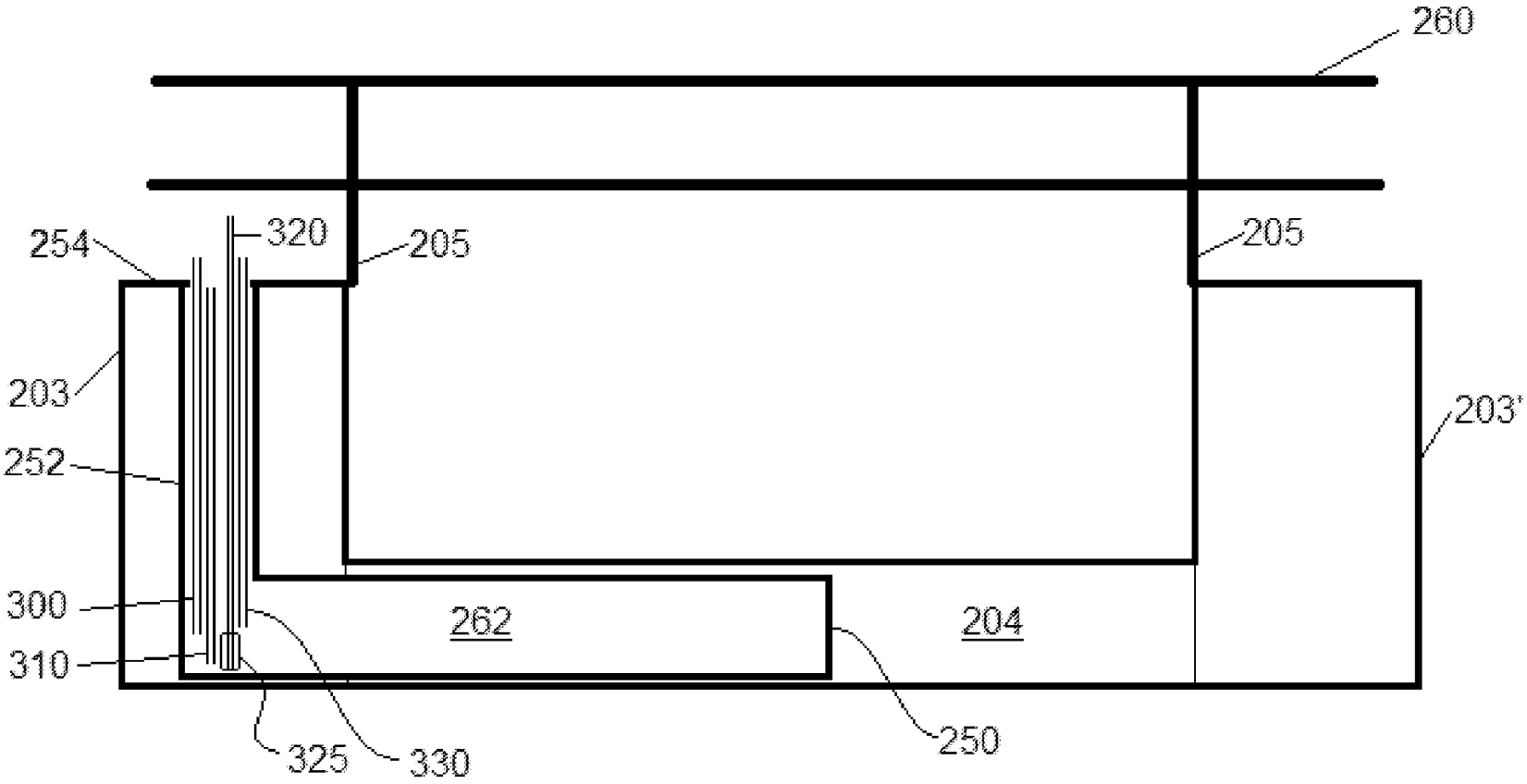
FIG. 12 is a schematic drawing of a ballast tank according to one embodiment of the invention within the hull of a TLP or a semi-submersible.

FIG. 12 is a schematic side view of a hull having columns 203 and 203' interconnected by pontoon 204. Deck structure 260 is supported on deck posts 205. Lower left pontoon tank 250 comprises horizontal portion 262 substantially contained within pontoon 204 and vertical shaft 252 substantially within column 203 and terminating at upper surface 254 of column 203.

A hatch or similar opening in upper surface 254 provides access to the interior of shaft 252. Shaft 252 may house ballast line 300, sounding line 310, temporary ballast or bilge line 320 (which may connect to submersible pump 325 or the like) and, instrumentation line 330.

It will be appreciated by those skilled in the art that vertical shaft 252 permits top-of-column access to pontoon tank 250. Such access can greatly reduce the complexity of associated systems.

An important advantage of a ballast system according to the present invention is its simplicity. There need be no valves in the system. There need be no tank penetrations. A submersible ballast pump may be used and the ballast pumps may be stored at the top of the hull where they can be easily inspected. There is no need for a pump room with all the required pump room equipment. The tank shafts may be an integral part of the hull structure. The shaft may be big enough that a back-up ballast pump can always be placed in the tank to evacuate any water. Similarly, a new sounding tube may be easily retrofitted. Monitoring equipment, e.g., level switches and tank level sensors, can be easily replaced or retrofitted without the need for hull entry or tank entry. A temporary ballast and/or bilge line may be lowered into the tank and service it.

Some embodiments of the invention may require the use of valves and a ring main. However these items may be located at or near the top of the hull and are thus easily serviceable. The top of the shaft may be sealed and penetrations are required here to allow the ballast, sounding and instrumentation lines to pass through. These penetrations (which are at top-of-hull level and are above any ballast water levels) can be more easily maintained.

Although particular embodiments of the present invention have been shown and described, they are not intended to limit what this patent covers. One skilled in the art will understand that that various changes and modifications may be made without departing from the scope of the present invention as literally and equivalently covered by the following claims.

What is claimed is:

1. A tension leg platform comprising:

a plurality of substantially vertical columns including a first column;

a plurality of substantially horizontal pontoons including a first pontoon connected to the first column and wherein each pontoon connects a pair of adjacent columns; and, at least one tank having a first portion substantially within the first pontoon and a substantially vertical second portion within the first column, wherein the top of the substantially vertical second portion of the tank is at approximately the same elevation as the top of the first column.

2. The tension leg platform recited in claim 1 wherein the substantially vertical second portion of the tank is sized and configured to function as a vent for the first portion of the tank.

3. The tension leg platform recited in claim 1 wherein the tank is a ballast tank.

4. The tension leg platform recited in claim 1 further comprising a ballast line within the substantially vertical second portion of the tank.

5. The tension leg platform recited in claim 1 further comprising an instrumentation line within the substantially vertical second portion of the tank.

6. The tension leg platform recited in claim 1 further comprising a sounding line within the substantially vertical second portion of the tank.

7. The tension leg platform recited in claim 1 further comprising a plurality of cofferdams surrounding at least a portion of the substantially vertical second portion of the tank.

8. The tension leg platform recited in claim 7 wherein the portion of the substantially vertical second portion of the tank surrounded by cofferdams comprises at least the upper extent of the substantially vertical second portion.

9. The tension leg platform recited in claim 7 wherein the portion of the substantially vertical second portion of the tank surrounded by cofferdams comprises at least the extent of the substantially vertical second portion located immediately above and immediately below the design waterline of the platform.

10. The tension leg platform recited in claim 1 further comprising a plurality of tanks having a first portion substantially within the first pontoon and a substantially vertical second portion within the first column connected to the first pontoon wherein the substantially vertical second portion of each tank is horizontally offset from the substantially vertical second portion of every other such tank.

11. The tension leg platform recited in claim 10 wherein the substantially vertical second portions of the plurality of tanks are adjacent one another.

12. The tension leg platform recited in claim 1 wherein the at least one tank having a first portion substantially within the first pontoon and a substantially vertical second portion within the first column connected to the first pontoon together comprise a single volume.

13. A semi-submersible comprising:

a plurality of substantially vertical columns including a first column;

a plurality of substantially horizontal pontoons including a first pontoon connected to the first column and wherein each pontoon connects a pair of adjacent columns; and, at least one tank having a first portion substantially within the first pontoon and a substantially vertical second portion within the first column, wherein the top of the substantially vertical second portion of the tank is at approximately the same elevation as the top of the first column.

14. The semi-submersible recited in claim 13 wherein the substantially vertical second portion of the tank is sized and configured to function as a vent for the first portion of the tank.

15. The semi-submersible recited in claim 13 wherein the tank is a ballast tank.

16. The semi-submersible recited in claim 13 further comprising a ballast line within the substantially vertical second portion of the tank.

17. The semi-submersible recited in claim 13 further comprising an instrumentation line within the substantially vertical second portion of the tank.

18. The semi-submersible recited in claim 13 further comprising a sounding line within the substantially vertical second portion of the tank.

19. The semi-submersible recited in claim 13 further comprising a plurality of cofferdams surrounding at least a portion of the substantially vertical second portion of the tank.

20. The semi-submersible recited in claim 19 wherein the portion of the substantially vertical second portion of the tank surrounded by cofferdams comprises at least the upper extent of the substantially vertical second portion.

21. The semi-submersible recited in claim 19 wherein the portion of the substantially vertical second portion of the tank surrounded by cofferdams comprises at least the extent of the substantially vertical second portion located immediately above and immediately below the design waterline of the platform.

22. The semi-submersible recited in claim 13 further comprising a plurality of tanks having a first portion substantially within the first pontoon and a substantially vertical second portion within the first column connected to the first pontoon wherein the substantially vertical second portion of each tank is horizontally offset from the substantially vertical second portion of every other such tank.

23. The semi-submersible recited in claim 22 wherein the substantially vertical second portions of the plurality of tanks are adjacent one another.

24. The semi-submersible recited in claim 13 wherein the at least one tank having a first portion substantially within the first pontoon and a substantially vertical second portion within the first column connected to the first pontoon together comprise a single volume.

* * * * *